US009358700B2

(12) United States Patent
Smith

(10) Patent No.: US 9,358,700 B2
(45) Date of Patent: Jun. 7, 2016

(54) STOCK GUIDE ASSEMBLY

(71) Applicant: Darrin E. Smith, Innisfil (CA)

(72) Inventor: Darrin E. Smith, Innisfil (CA)

(73) Assignee: JessEM Products Limited, Barrie (CA)

( * ) Notice: Subject to any disclaimer, the term of this patent is extended or adjusted under 35 U.S.C. 154(b) by 117 days.

(21) Appl. No.: 13/904,803

(22) Filed: May 29, 2013

(65) Prior Publication Data

US 2014/0352512 A1 Dec. 4, 2014

(51) Int. Cl.

| | |
|---|---|
| ***B27B 11/02*** | (2006.01) |
| ***B26D 7/06*** | (2006.01) |
| ***B27C 5/06*** | (2006.01) |
| ***B27B 27/02*** | (2006.01) |

(52) U.S. Cl.

CPC . *B27C 5/06* (2013.01); *B27B 27/02* (2013.01); *Y10T 83/743* (2015.04)

(58) Field of Classification Search

CPC ..... B27C 5/06; B27B 27/02; Y10T 83/743
USPC ..... 83/477, 450, 447, 448, 446, 439
See application file for complete search history.

(56) References Cited

U.S. PATENT DOCUMENTS

| | | | | |
|---|---|---|---|---|
| 2,817,376 | A | 12/1957 | Johannsen | |
| 3,221,583 | A | 12/1965 | Nichols et al. | |
| 3,738,403 | A | 6/1973 | Schwoch et al. | |
| 4,048,883 | A * | 9/1977 | Lecrone | 83/871 |
| 4,212,214 | A * | 7/1980 | Bippus | 83/102.1 |
| 4,476,757 | A | 10/1984 | Morris | |
| 5,000,237 | A | 3/1991 | Berkeley et al. | |
| 5,148,846 | A * | 9/1992 | Van Gelder | 144/250.13 |
| 5,546,670 | A | 8/1996 | Chiang | |
| 5,881,623 | A * | 3/1999 | Otani et al. | 83/455 |
| 6,619,347 | B2 | 9/2003 | Jukoff et al. | |
| 6,718,857 | B2 | 4/2004 | Kimmel et al. | |
| 6,968,766 | B2 | 11/2005 | Kimmel et al. | |
| 7,017,464 | B2 | 3/2006 | Coderre | |
| 7,140,286 | B2 | 11/2006 | Schwartz | |
| 7,299,840 | B1 | 11/2007 | Moschetti | |
| 7,341,081 | B1 | 3/2008 | Villiger | |
| 7,882,866 | B2 | 2/2011 | Burrows | |
| 7,942,174 | B2 * | 5/2011 | Kozina et al. | 144/253.6 |
| 2002/0144752 | A1 * | 10/2002 | Jones | 144/253.1 |
| 2002/0162439 | A1 | 11/2002 | Fontaine | |
| 2010/0307302 | A1 | 12/2010 | Smith | |
| 2014/0041494 | A1 * | 2/2014 | Kelly et al. | 83/13 |

OTHER PUBLICATIONS

International Search Report and Written Opinion for Application No. PCT/CA2014/050491, Jul. 22, 2014, 7 pages.

* cited by examiner

*Primary Examiner* — Omar Flores Sanchez
(74) *Attorney, Agent, or Firm* — Senniger Powers LLP

(57) ABSTRACT

A stock guide assembly for use with a work table to guide movement of stock along the work table in a feed direction includes a body. The body includes a portion lying in a plane parallel to the feed direction when used to guide movement of the stock. An adjustment mechanism is associated with the body for attaching the body to the work table and permitting the body to be adjusted on the table along an x-axis and a y-axis. A roller assembly is mounted on the body. The roller assembly includes a roller mounted for rotation relative to the body. The roller is positioned at a skew angle relative to the body portion plane and to the feed direction when used to guide movement of the stock. A second stock guide assembly substantially similar to the first stock guide assembly can be provided for use with the work table.

18 Claims, 14 Drawing Sheets

STOCK GUIDE ASSEMBLY

BACKGROUND

The present invention relates generally to cutting apparatus and accessories and more particularly to a stock guide assembly.

A stock guide is an accessory (e.g., a featherboard) used with a work table such as a table saw or router table to guide a piece of stock along the table as the stock is cut by a cutting implement. The featherboard opposes forces generated by the cutting implement tending to push the stock away from the cutting implement as the stock is moved past the cutting implement. Conventional featherboards are mounted on the work table and adjusted to a desired position to accommodate the size of the stock to be cut. However, conventional featherboards do not oppose forces generated by the cutting implement in two directions (e.g., vertical and horizontal forces). Accordingly, there exists a need for a stock guide having improved guiding capabilities.

SUMMARY

In one aspect, the invention is directed to a stock guide assembly for use with a work table to guide movement of stock along the work table in a feed direction. The stock guide assembly includes a body including a portion lying in a plane parallel to the feed direction when used to guide movement of the stock. An adjustment mechanism is associated with the body for attaching the body to the work table and permitting the body to be adjusted on the table along a first, x-axis and permitting the body to be adjusted along a second, y-axis. A roller assembly is mounted on the body. The roller assembly includes a roller mounted for rotation relative to the body. The roller is positioned at a skew angle relative to the body portion plane and to the feed direction when used to guide movement of the stock.

In another aspect, the invention is directed to a stock guide assembly for use with a work table to guide movement of stock along the work table in a feed direction. The stock guide assembly includes a body. The body includes an elongate curved slot, a hole, and at least one opening. The body includes a portion lying in a plane parallel to the feed direction when used to guide movement of the stock. An adjustment mechanism is associated with the body for attaching the body to the work table. The adjustment mechanism is associated with the elongate curved slot and the hole of the body to permit the body to be adjusted along a horizontal axis and to permit the body to be adjusted along a vertical axis. A roller mount is associated with the body and includes a mounting face. The mounting face is angled relative to the body portion plane. The mounting face includes a hole and a shoulder disposed in the hole. An axle has a flange and a shaft that engages the shoulder. The axle is connected to the roller mount by a fastener that extends through the axle and through the hole in the mounting face. A roller is mounted on the axle and secured between the mounting face and the flange of the axle. The roller engages the mounting face and is oriented at a skew angle relative to the body portion plane. The roller is configured for rotational movement about the shaft of the axle.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
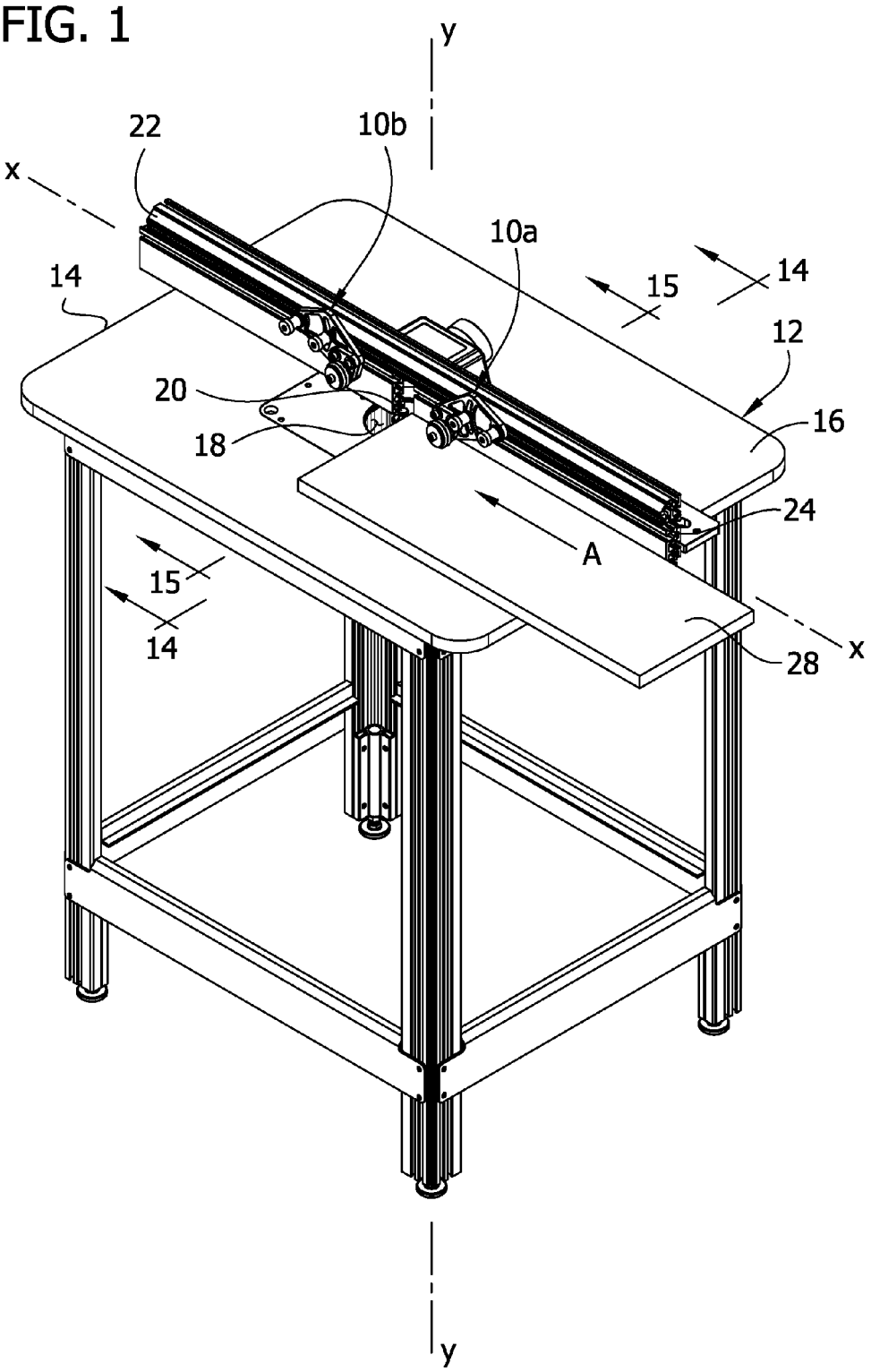
FIG. 1 is a perspective of an infeed stock guide assembly and an outfeed stock guide assembly of the present invention attached to a work table.
Figure 14:
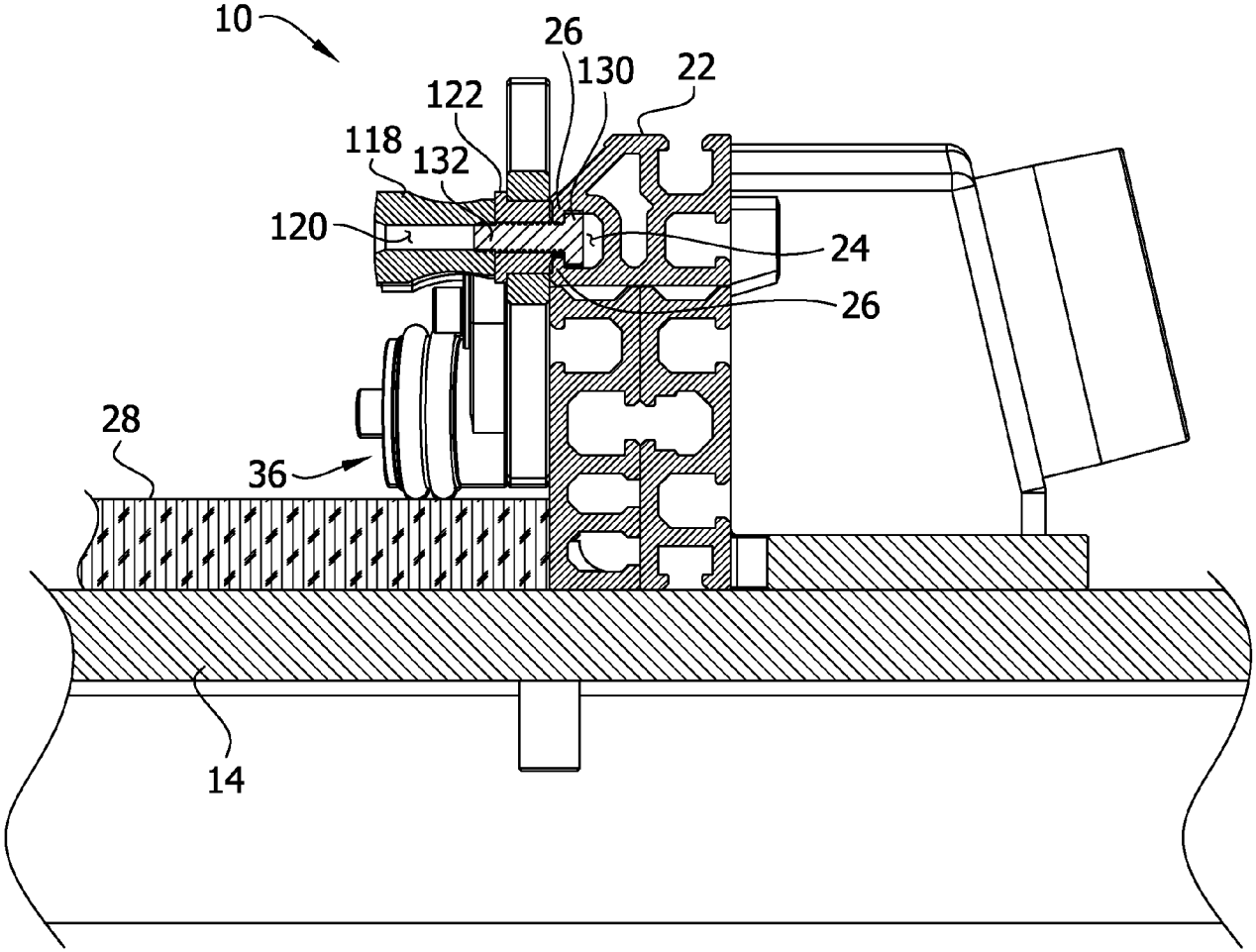
FIG. 14 is a section taken along line 14-14 of FIG. 1.
Figure 15:
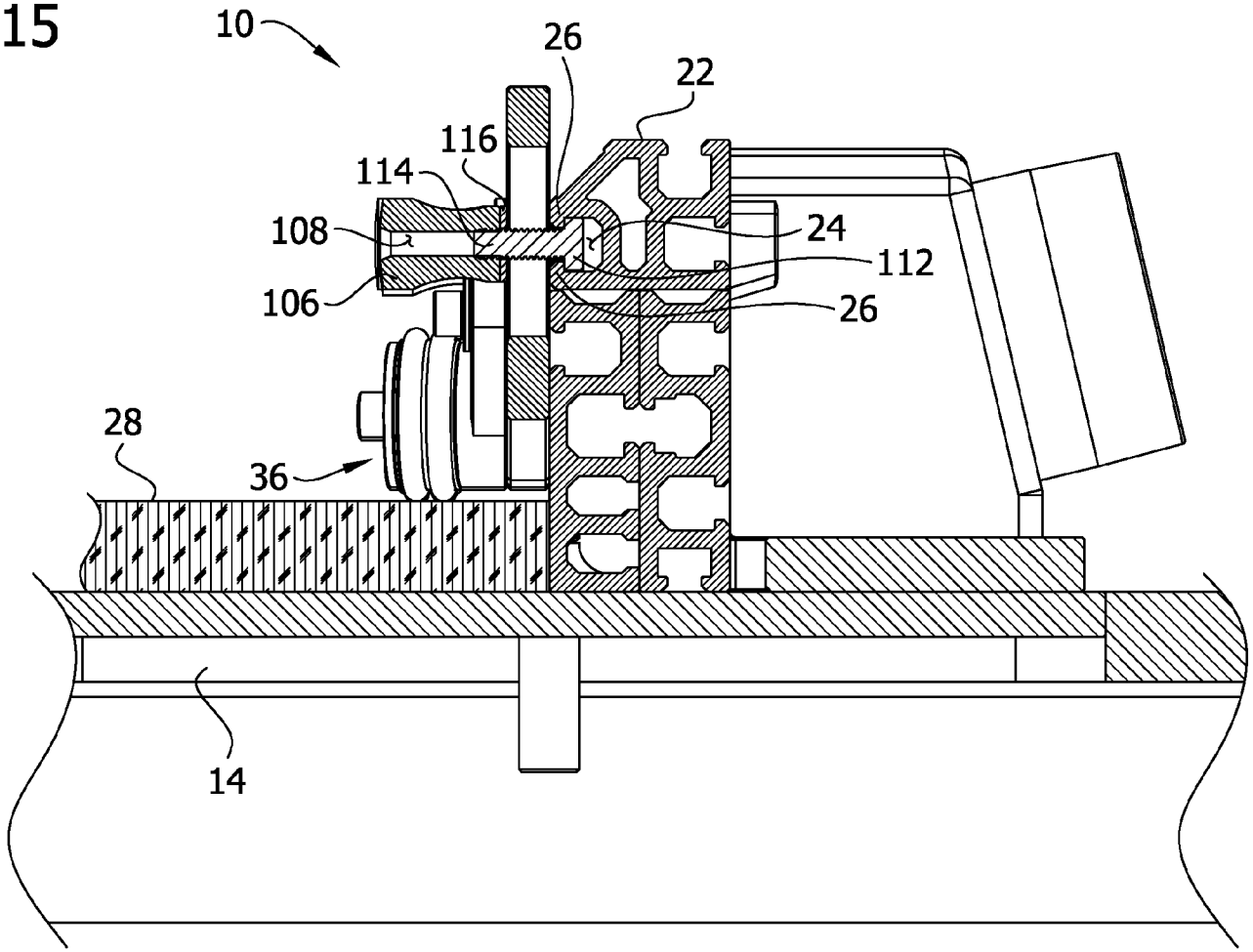
FIG. 15 is a section taken along line 15-15 of FIG. 1.

Referring to FIG. 1, a stock guide assembly is generally indicated at 10. The stock guide assembly 10 is adapted for attachment to a work table 12. In the illustrated embodiment, a pair of stock guide assemblies 10, including an infeed stock guide assembly 10*a* and an outfeed stock guide assembly 10*b*, is attached to the work table 12. FIG. 1 depicts the work table 12 as a router table including a table 14 having a surface 16, an opening 18 in the table, and a router 20 extending through the opening. Only the bit of the router 20 may be seen in the drawings. A fence 22 is positioned on the surface 16 of the table 14 adjacent the router 20. The fence 22 has a channel 24 extending along the length of the fence. The channel 24 has lips 26 (see FIGS. 14 and 15). The stock guide assembly 10 and fence 22 are adapted to guide a workpiece or piece of stock 28 (e.g., a piece of wood) past the router 20 as the stock is moved across the surface 16 of the table 14 in a feed direction (indicated by arrow A) from an infeed side of the router to an outfeed side of the router. The fence 22 is positioned so that the stock 28 has the proper location relative to the bit of the router 20 to make the desired cut in the stock. The stock guide assembly 10 can be used with other work tables such as table saws without departing from the scope of the invention. Moreover, the fence 22 may be considered part of the stock guide assembly. By way of nonlimiting example, the fence may form part or all of the stock guide assembly body (not shown).

Referring to FIGS. 2-6, the stock guide assembly 10 comprises a body 34, a roller assembly 36, and an adjustment mechanism 38 associated with the body for attaching the body to the fence 22. The adjustment mechanism 38 permits the body 34 to be adjusted with respect to the table 14 along a first, x-axis and along a second, y-axis. In the illustrated embodiment, the x-axis corresponds to the longitudinal axis of the fence 22, and the y-axis extends generally at 90 degrees with respect to the x-axis in a generally vertical plane. However, the axes can be oriented at other angles and orientations with respect to each other.

Figure 4:
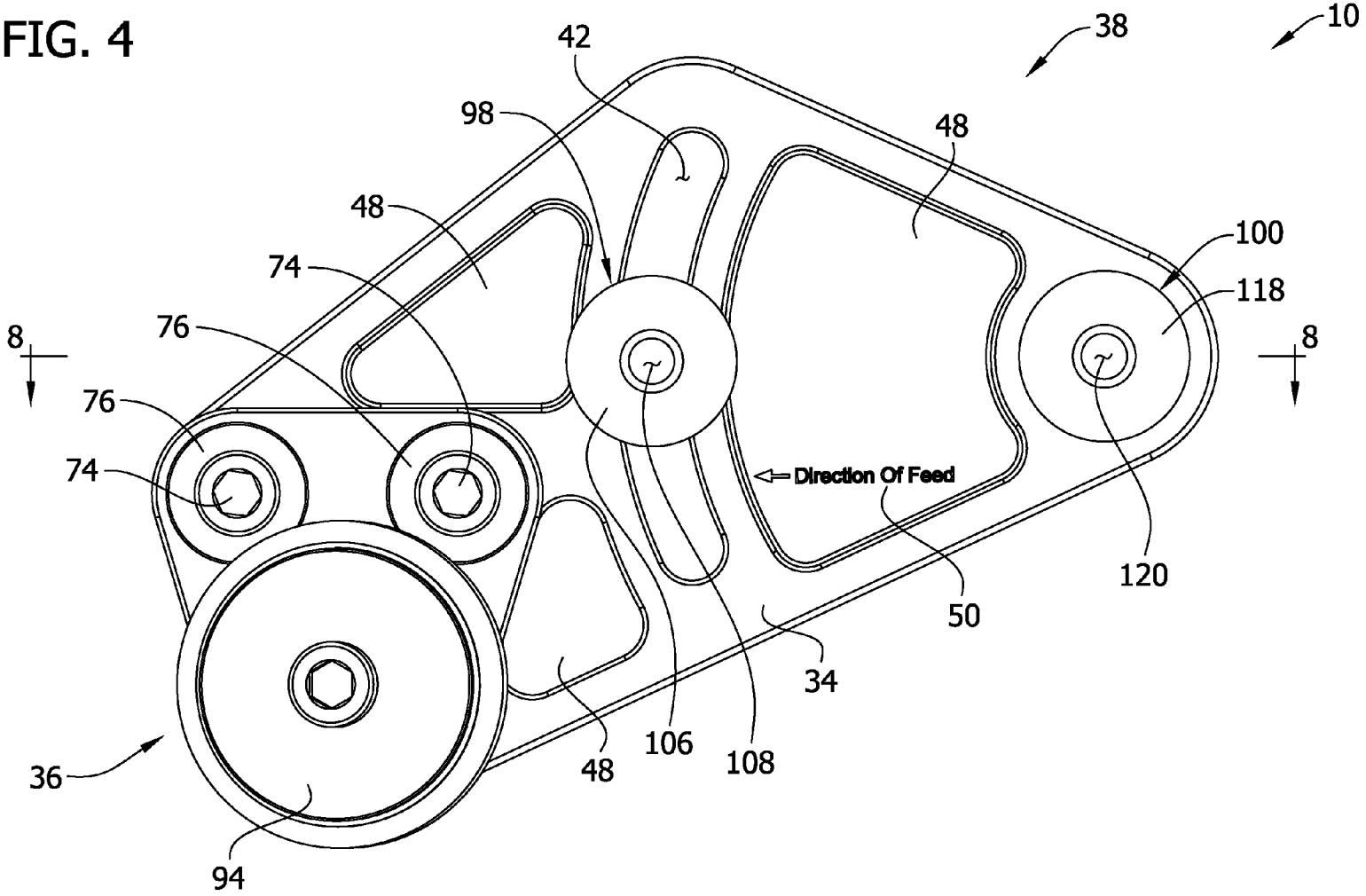
FIG. 4 is a front view of the infeed stock guide assembly.
Figure 5:
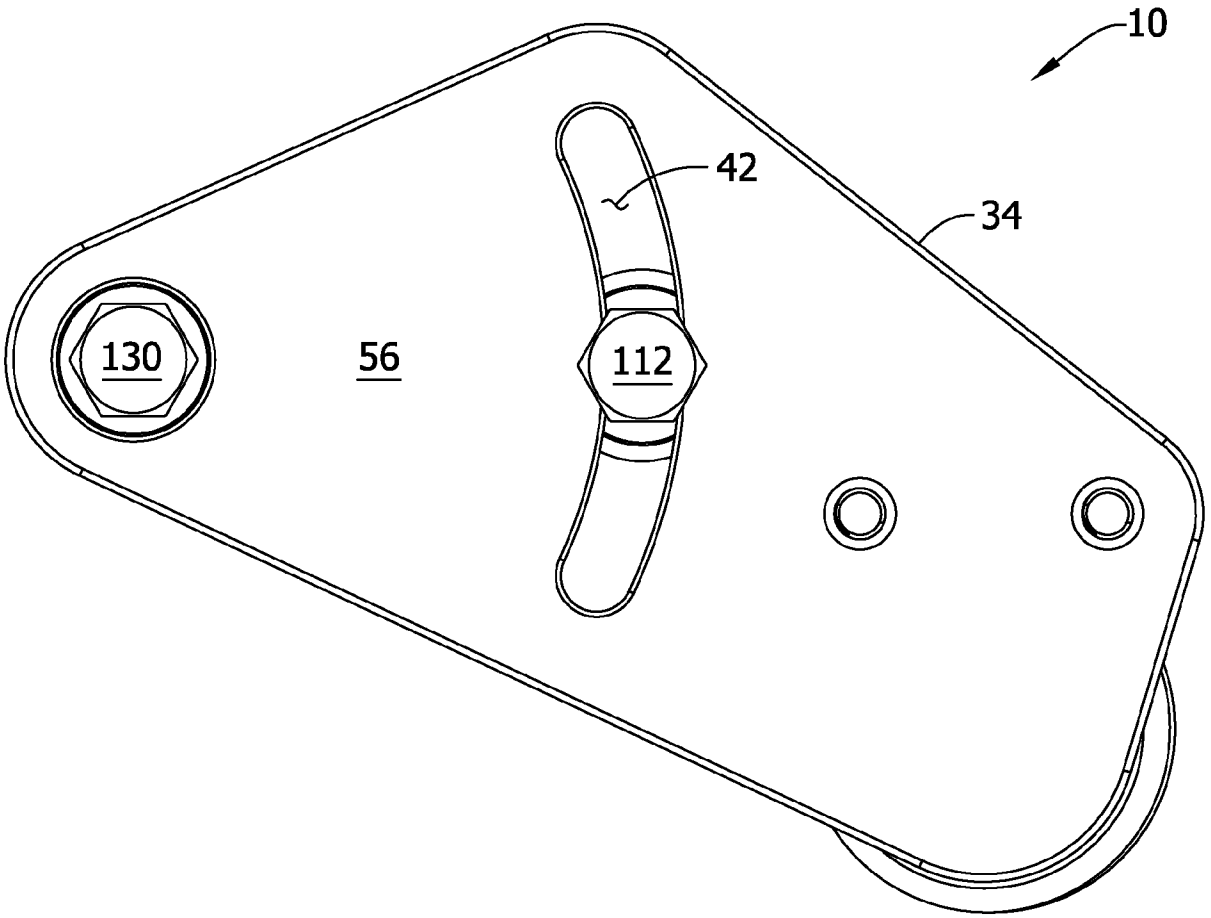
FIG. 5 is a rear view of the infeed stock guide assembly of FIG. 4.
Figure 6:
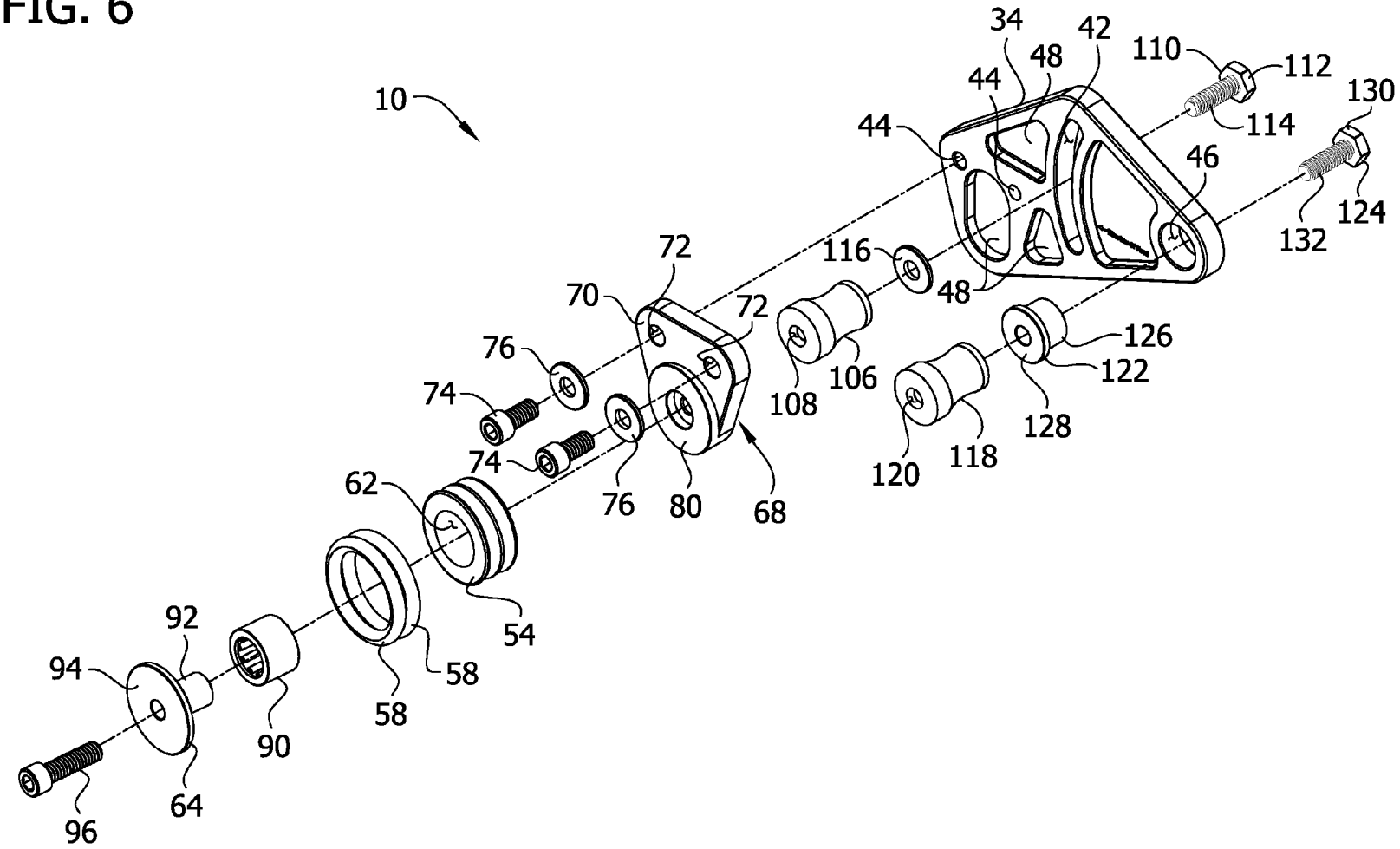
FIG. 6 is an exploded perspective of the infeed stock guide assembly.

Referring to FIGS. 4-6, the stock guide assembly 10 (specifically the infeed stock guide assembly 10*a*) includes an elongate curved slot 42 generally centered in the body 34. At one end of the body 34 is at least one opening 44 configured to receive a fastener. At another end of the body 34 opposite the at least one opening 44 is a hole 46 extending through the body. The body 34 can include a plurality of cutouts, openings and/or cavities 48 to reduce the amount of material used to make the stock guide assembly 10. The body 34 includes markings 50 indicating the feed direction A to assist a user in positioning the stock guide assembly 10 on the fence 22 with respect to the table 14.

Figure 7:
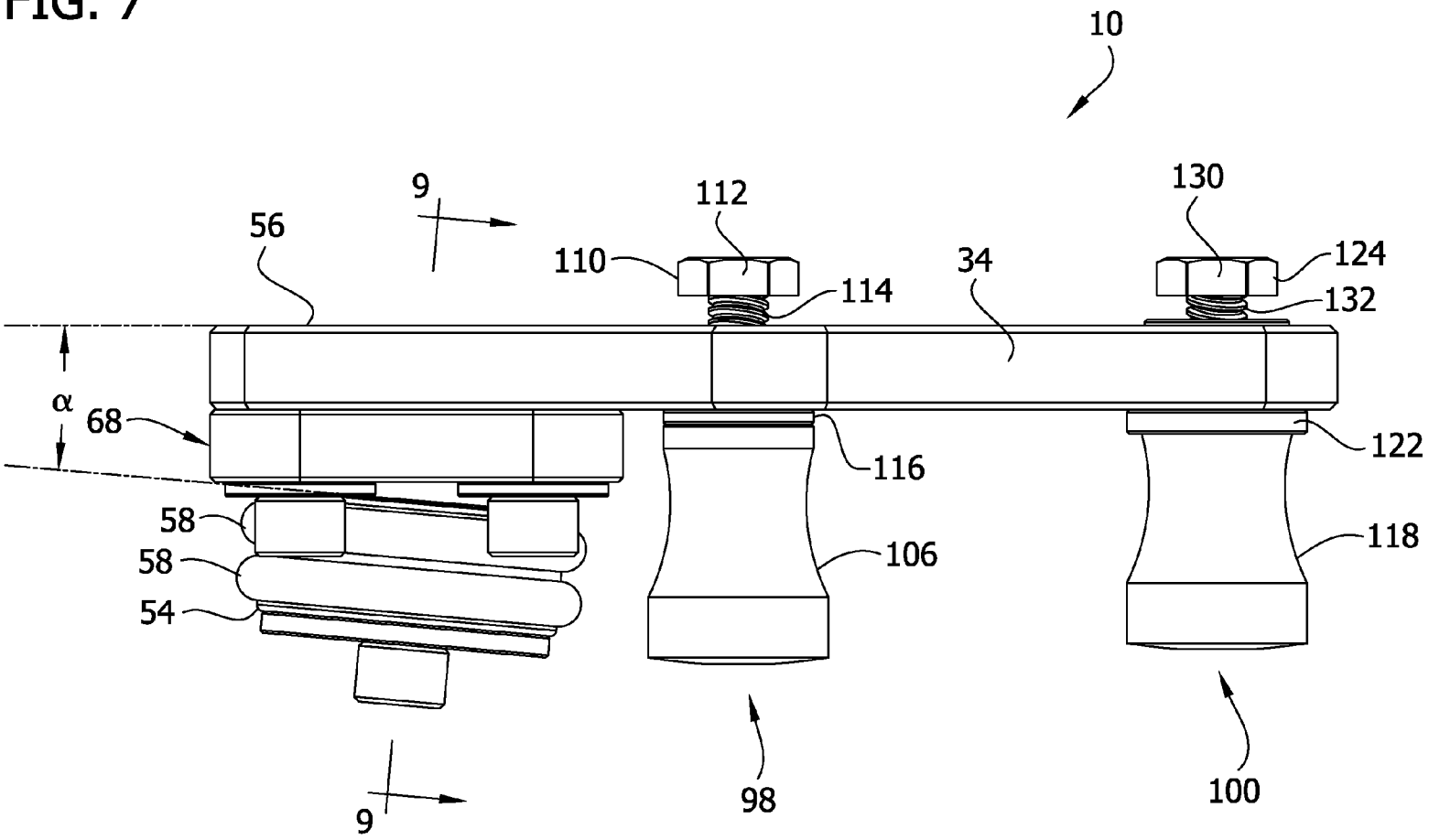
FIG. 7 is a top view of the infeed stock guide assembly.
Figure 9:
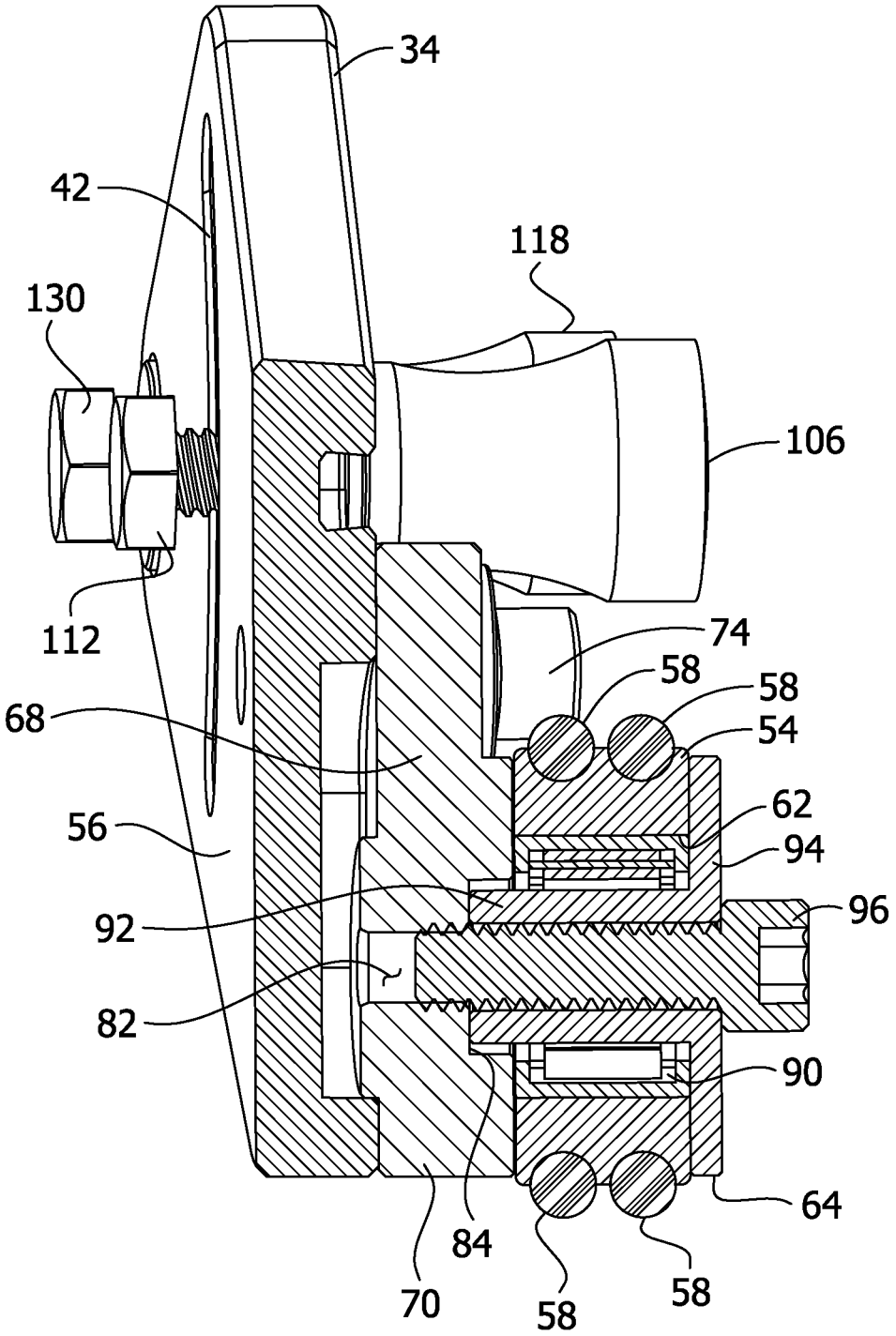
FIG. 9 is a section taken along line 9-9 of FIG. 7.
Figure 10:
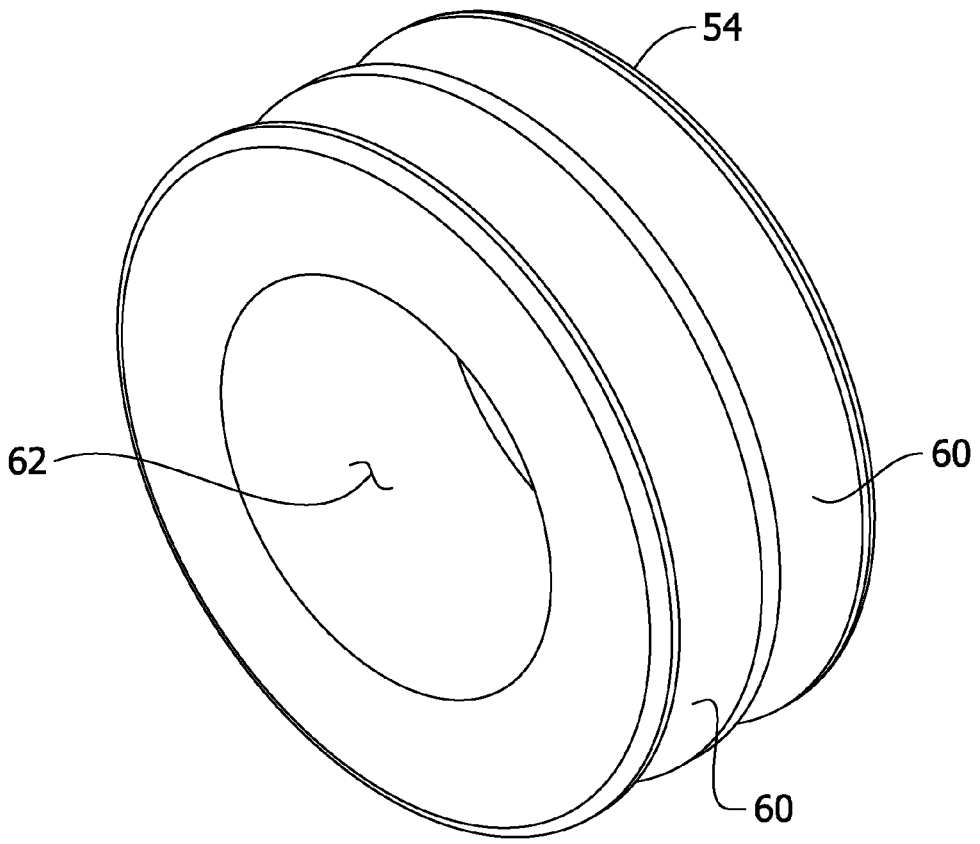
FIG. 10 is a perspective of a roller of the present invention.
Figure 11:
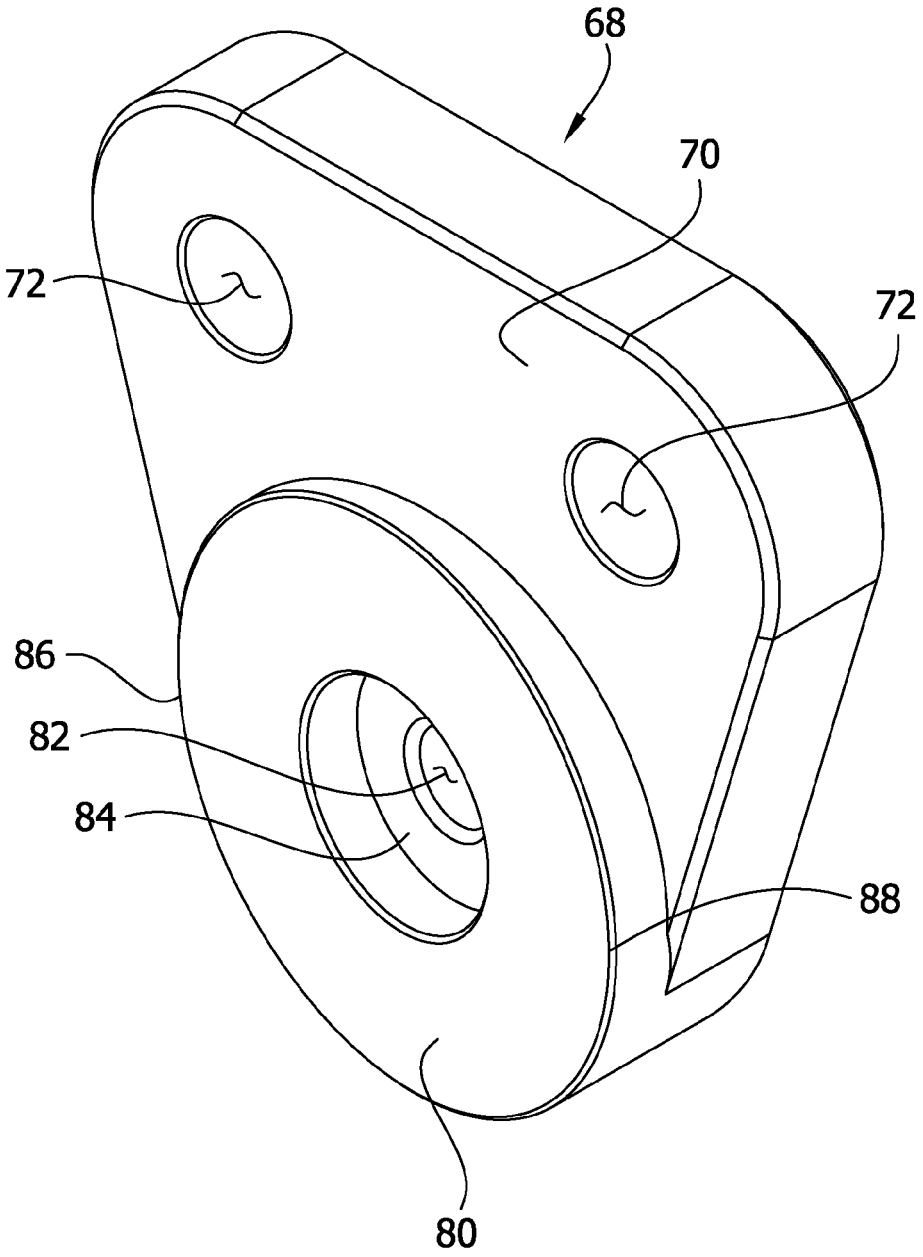
FIG. 11 is a perspective of a roller mount of the present invention.
Figure 12:
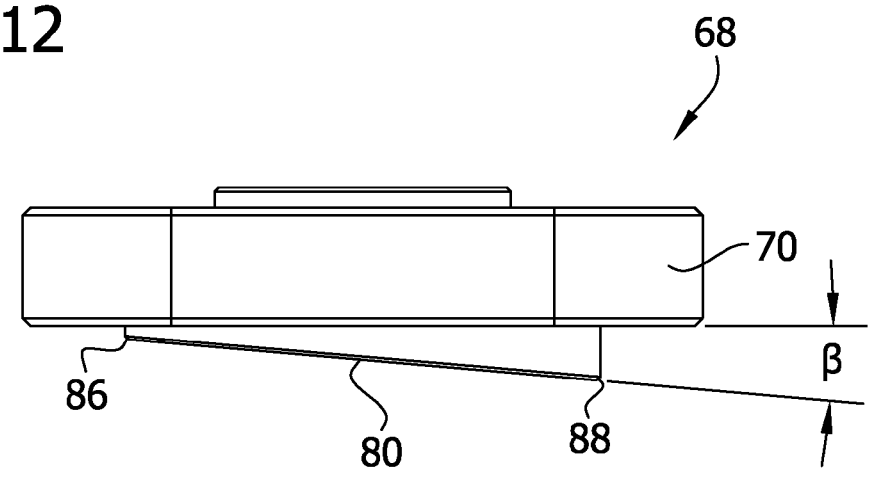
FIG. 12 is a top view of the roller mount of FIG. 11.
Figure 13:
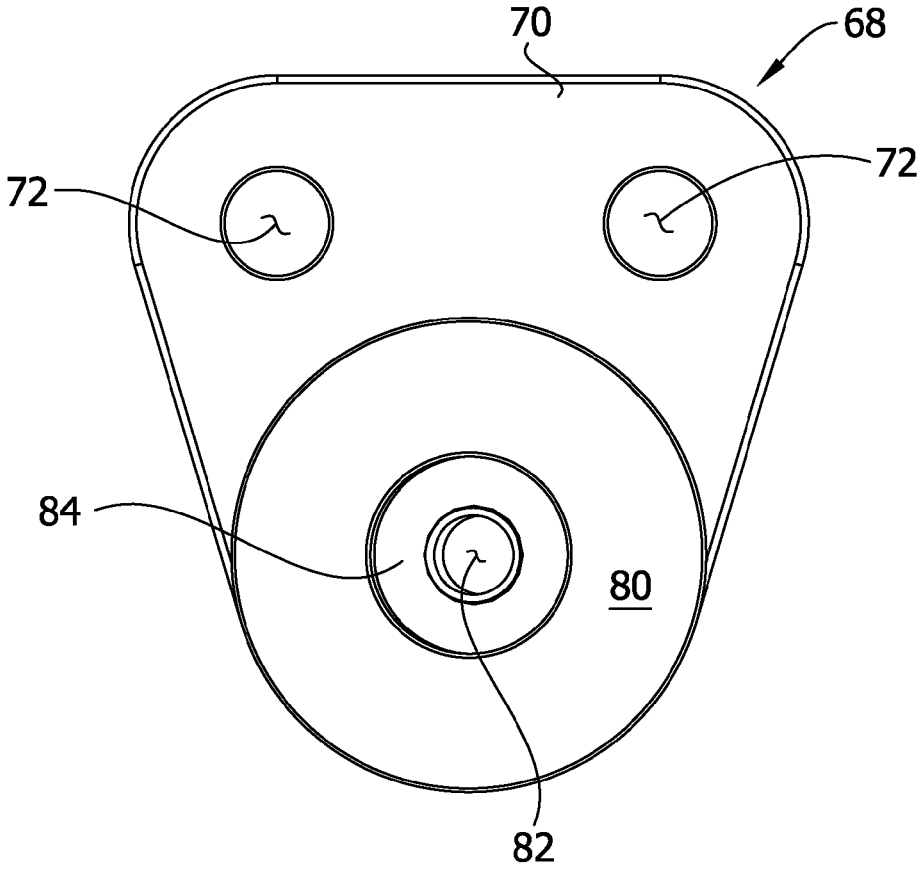
FIG. 13 is a front view of the roller mount of FIG. 11.

Referring to FIGS. 6, 7, and 9, the roller assembly 36 includes a roller 54 mounted on the body 34 for rotational movement relative to the body. The roller 54 is mounted on the body 34 at an angle α relative to a back surface 56 of the body. Preferably, the roller 54 is mounted at a skew angle α relative to the body 34. In the illustrated embodiment, it is the back surface 56 (broadly, "portion lying in a plane parallel to the feed direction") that engages the fence 22 and orients the body 34 parallel with the feed direction A. However, other arrangements are possible. It will be understood that the structure will be such as to cause the roller 54 to angle relative to the feed direction A to pull the stock 28 toward the fence 22 as the stock is fed in the feed direction past the router 20. In the illustrated embodiment, the angle α is less than 90 degrees. The angle α is preferably within the range of about 3 degrees to about 10 degrees. In one embodiment, the angle α is about 5 degrees. At least one tire or O-ring 58 is disposed on the roller 54. The O-ring 58 reduces markings on the stock 28 when the stock guide assembly 10 comes in contact with the stock while also gripping the stock to resist lateral movement. In the illustrated embodiment, the roller 54 includes two O-rings 58. Each O-ring can be any suitable size, such as 3/16 inch O-rings. As seen in FIG. 10, the roller 54 is generally cylindrical. The roller 54 has one channel 60 for each O-ring 58. An opening 62 extends through the roller 54 for mounting the roller on an axle 64 for rotation of the roller relative to the body 34.

The roller 54 is mounted on a roller mount 68 that is attached to the body 34. As shown in FIGS. 6 and 11-13, the roller mount 68 includes a base 70 having an opening 72 for receiving a fastener 74 therethrough. In the illustrated embodiment, the base 70 has two openings 72 for receiving two fasteners 74 therethrough. The fasteners 74 attach the roller mount 68 to the body 34 of the stock guide assembly 10 by extending through the base 70 and through the openings 44 in the body. Washers 76 are disposed between each fastener 74 and the roller mount 68. A mounting face 80 extends outward from the base 70 and includes a hole 82 extending therethrough. The hole 82 is countersunk to provide a shoulder 84 disposed in the hole. The mounting face 80 extends at an angle β to the base 70 and to the back surface plane 56. The angle β is preferably a non-parallel angle less than 90 degrees. In one embodiment, the angle β is within the range of about 3 degrees to about 10 degrees. In another embodiment, the angle β is about 5 degrees. In the illustrated embodiment, the angle β of the mounting face 80 is substantially identical to the angle α of the roller 54. However, other configurations, such as the angle β being larger or smaller than the angle α, are within the scope of the present invention. The mounting face 80 is planar and extends from a first end 86 spaced from the base 70 to a second end 88 spaced from the base a greater amount than the first end (see, e.g., FIG. 12). In the illustrated embodiment, engagement with the angled mounting face 80 is what angles the roller 54 relative to the body 34. Other configurations for attaching the roller 54 at an angle to the body 34 and the back surface plane 56 are within the scope of the present invention.

The roller 54 is positioned against the mounting face 80. A one-way bearing 90 is positioned in the opening 62 of the roller 54. The axle 64 extends through the one-way bearing 90 and through the roller 54 to engage the shoulder 84 (FIG. 9). The axle 64 includes a shaft 92 around which the roller 54 rotates and a flange 94 that prevents the roller from moving away from the mounting face 80. A fastener 96 extends through the axle 64, the one-way bearing 90, and the roller 54 and attaches the roller to the roller mount 68 in a threaded opening angled with respect to the body the same as the mounting face 80. The one-way bearing 90 permits rotation of the roller 54 in one direction (i.e., the direction indicated by arrow B, see FIGS. 2 and 3) and prevents rotation of the roller in the opposite direction. This unidirectional rotation of the roller 54 permits feeding of the stock 28 along the table 14 in only one direction, the feed direction A. Thus, the roller assembly 36 resists kick back of the stock 28 (i.e., in a direction opposite to the feed direction) caused by engagement with the router bit. It is understood that the one-way bearing can be omitted within the scope of the present invention.

Figure 8:
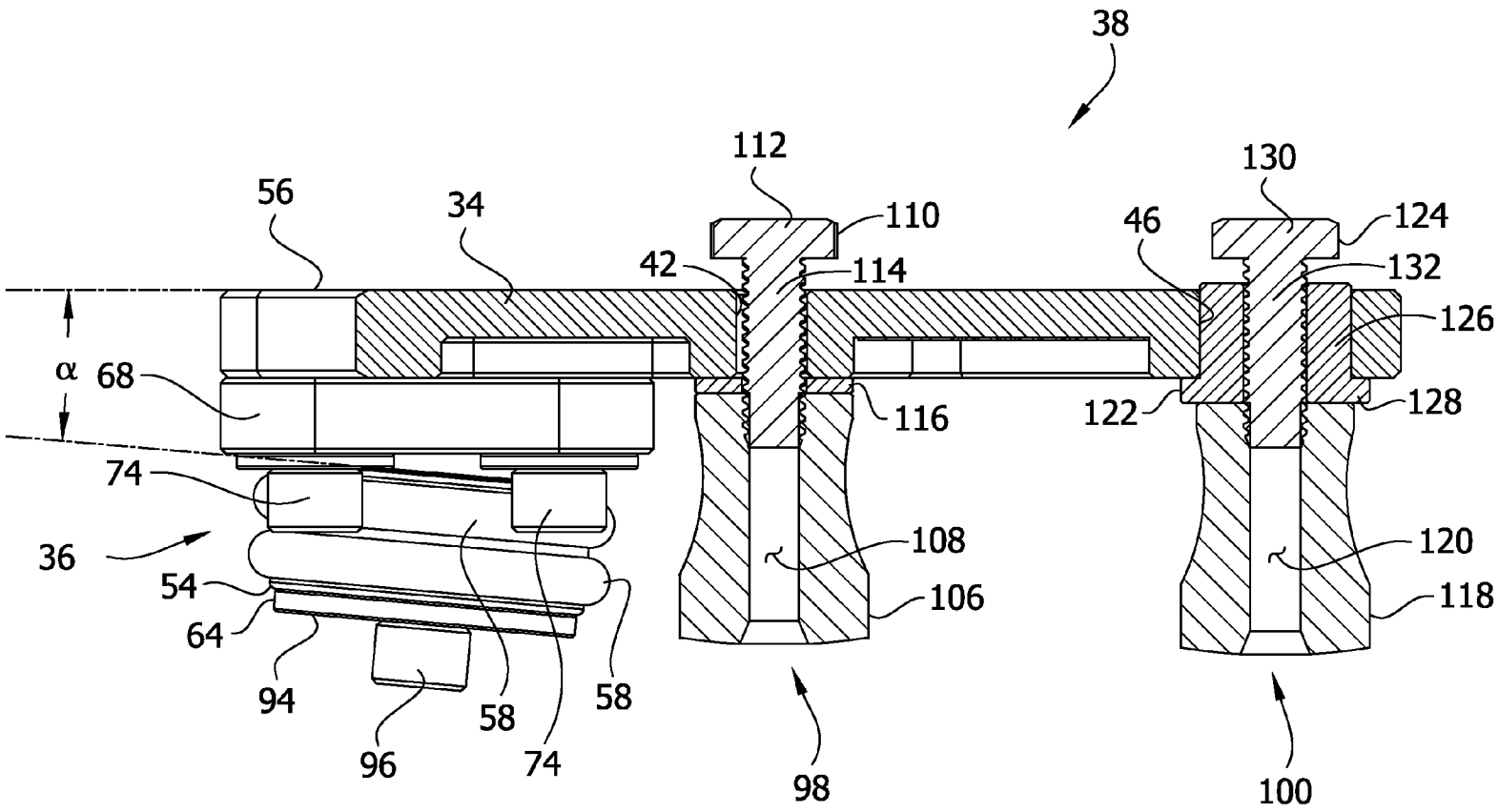
FIG. 8 is a section taken along line 8-8 of FIG. 4.

Referring to FIGS. 7 and 8, the adjustment mechanism 38 comprises a first fastener assembly 98 and a second fastener assembly 100. The first fastener assembly 98 includes a knob 106 having an opening 108 extending therethrough and a fastener such as a hex head screw 110. A head 112 of the screw 110 is received in the channel 24 of the fence 22. The lips 26 of the channel 24 retain the head 112 in the channel (see FIG. 15). A shaft 114 of the screw 110 extends through the elongate curved slot 42 on the body 34 and into the opening 108 of the knob 106. A washer 116 is disposed between the knob 106 and the body 34. The shaft 114 of the screw 110 is movable along the slot 42 to adjust the height of the stock guide assembly 10.

The second fastener assembly 100 includes a knob 118 having an opening 120 extending therethrough, a pivot bushing 122, and a fastener such as a hex head screw 124. A sleeve 126 of the pivot bushing 122 extends through the hole 46 in the body 34 and a flange 128 of the bushing engages a surface of the body adjacent the hole. A head 130 of the screw 124 is received in the channel 24 of the fence 22. The lips 26 of the channel 24 retain the head 130 in the channel (see FIG. 14). A shaft 132 of the screw extends through the hole 46 in the body 34, through the pivot bushing 122, and into the opening 120 of the knob 118.

Figure 2:
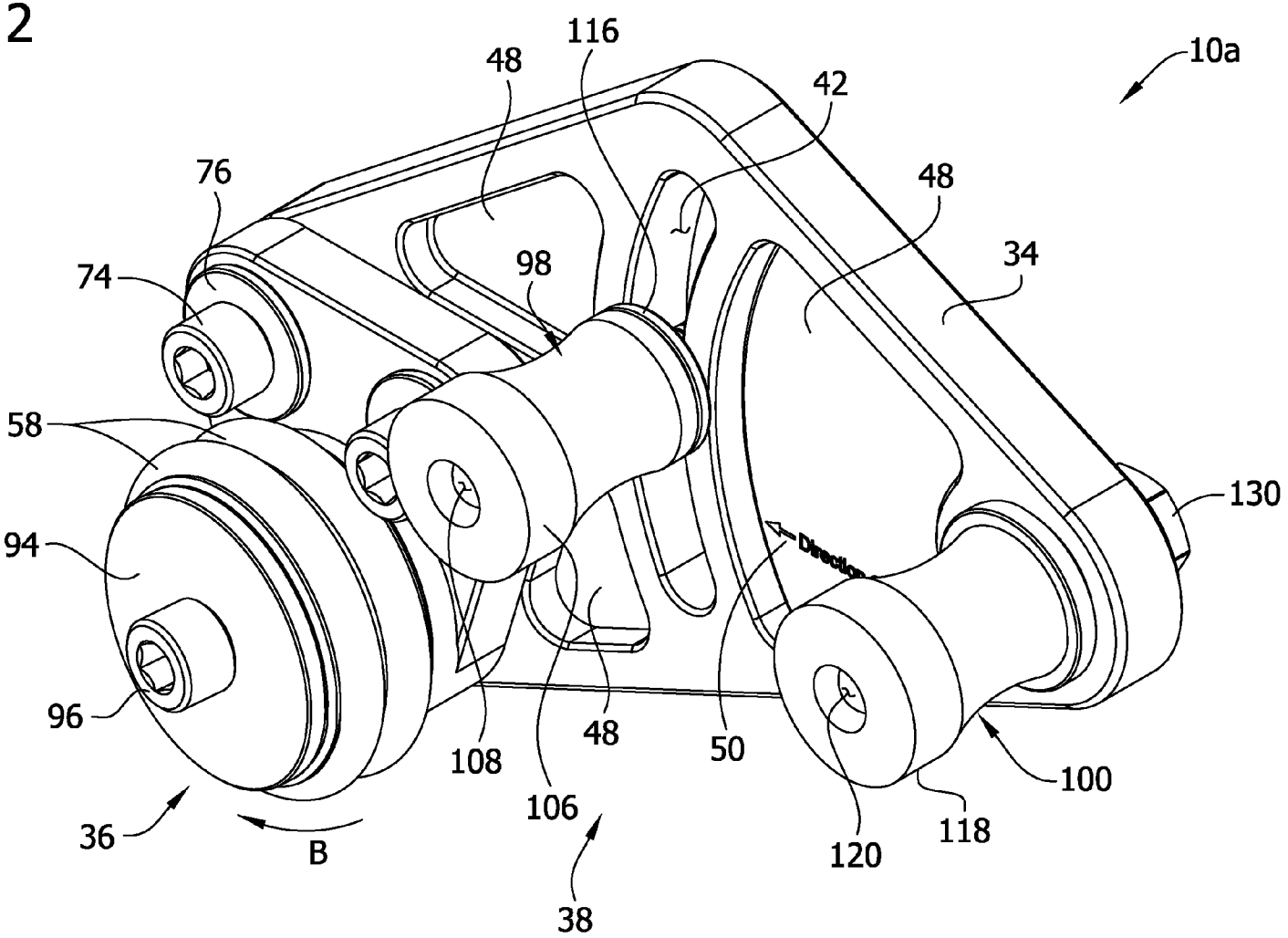
FIG. 2 is a perspective of the infeed stock guide assembly.
Figure 3:
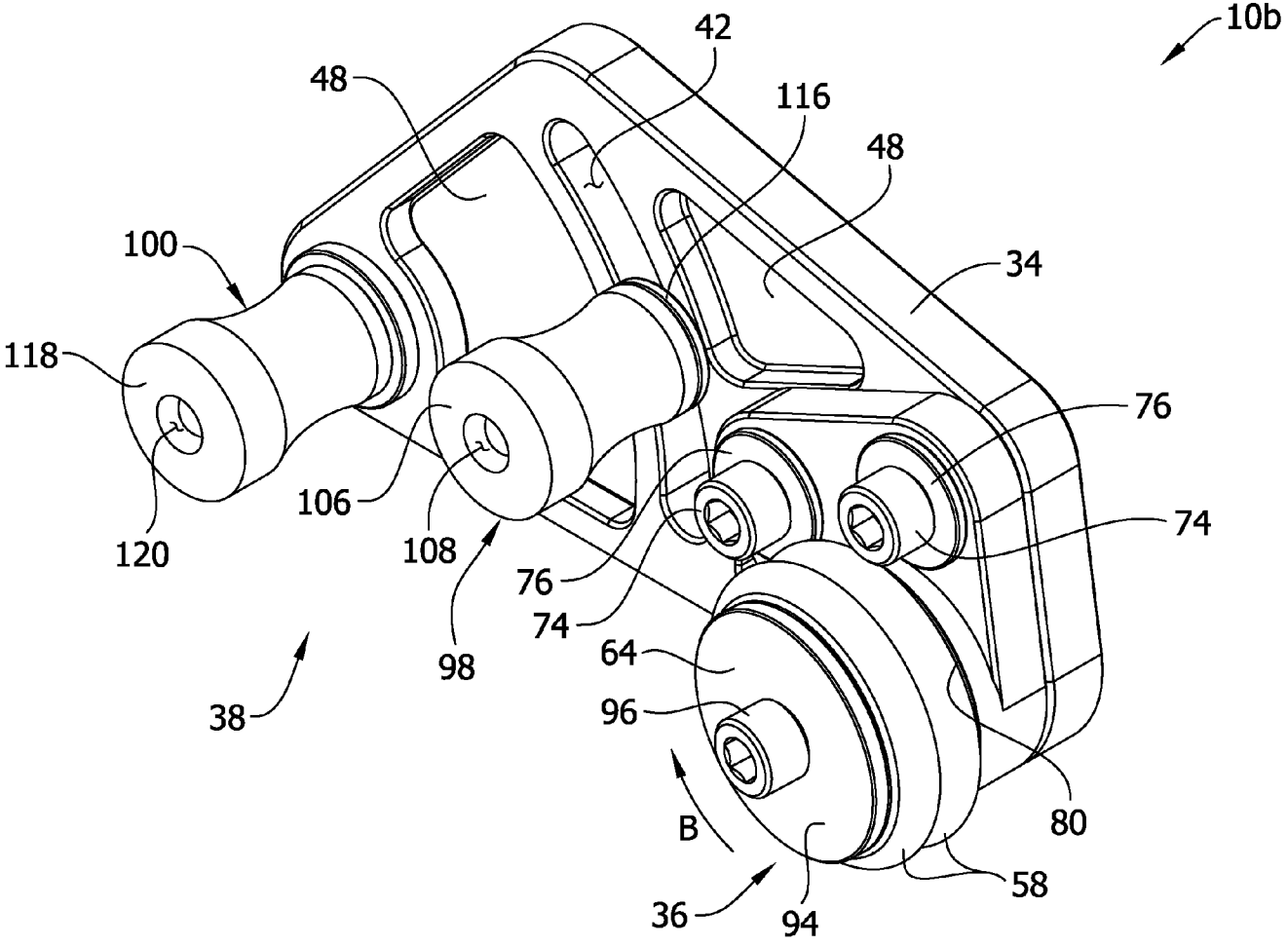
FIG. 3 is a perspective of the outfeed stock guide assembly.

The description above refers to only one stock guide assembly 10; however, the description applies to both the infeed stock guide assembly 10*a* (which is particularly described) and the outfeed stock guide assembly 10*b* (which is not particularly described). The infeed stock guide assembly 10*a* and the outfeed stock guide assembly 10*b* include the same features in opposite configurations, such that the roller assembly 36 of each is positioned closest to the router 20. As seen in FIG. 2, the infeed stock guide assembly 10*a* includes the adjustment mechanism 38 on the infeed side of the stock guide assembly and the roller assembly 54 on the outfeed side. In contrast, as seen in FIG. 3, the outfeed stock guide assembly 10*b* includes the roller assembly 36 on the infeed side of the stock guide assembly and the adjustment mechanism 38 on the outfeed side.

Use of the stock guide assembly 10 will now be described with reference to FIGS. 1-15. The user inserts the hex head screws 110, 124 of the stock guide assembly 10 into the channel 24 of the fence 22. The user then slides the stock guide assembly 10 along the channel 24 until the assembly is positioned at a desired horizontal or x-axis location along the channel. Once the stock guide assembly 10 is in the desired location along the channel 24, the second fastener assembly 100 is tightened by turning the knob 118, thereby pushing the body 34 against the lips 26 of the channel. Then the vertical position of the roller assembly 10 can be adjusted by pivoting the body 34 so that the screw 110 moves along the curved slot 42. The body 34 is pivoted on the pivot bushing 122 so that the height of the roller 54 above the table top is such that the stock passing under the roller compresses the O-rings 58 so that the stock is gripped by the roller assembly. Once the stock guide assembly 10 is in the desired vertical or y-axis position, the first fastener assembly 98 is tightened by turning the knob 106, thereby pushing the body 34 against the lips 26 of the channel and securing the body in place. The outfeed stock guide assembly can be positioned in the same way.

Once both stock guide assemblies 10*a*, 10*b* are positioned as desired and secured in place, the user can feed a piece of stock 28 past the router 20. The roller assembly 36 contacts a top surface of the stock 28 and exerts a downward force on the stock to counteract the upward force on the stock from the router 20. The angle α of the roller 54 urges the stock 28 toward the fence 22 to counteract the horizontal force away from the fence that the router exerts on the stock. Thus, the stock 28 is maintained in the desired position because the stock guide assembly 10 opposes forces generated by the router 20 tending to push the stock upward away from the router and outward away from the fence 22. The roller assembly 36 via the one-way bearing 90 resists movement of the stock 28 in a direction opposite the feed direction A.

It is understood that various configurations are within the scope of the present invention. For example, only one stock guide assembly 10 can be used instead of providing both an infeed stock guide assembly 10*a* and an outfeed stock guide assembly 10*b*. Alternatively, the stock guide assembly can include two roller assemblies on one body. Instead of one curved slot 42 and one hole 44, the body can include two vertical slots for adjusting of the position of the stock guide assembly 10. The roller assembly 36 can be attached to a different body configured for mounting on the work table 12. The mounting face 80 can be parallel to the feed direction A, and the stock guide assembly 10 can include other structure for orienting the roller 54 at an angle relative to the feed direction.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A stock guide assembly for use with a work table to guide movement of stock along the work table in a feed direction, the stock guide assembly comprising:

a body including a portion lying in a plane parallel to the feed direction when used to guide movement of the stock, the body including an elongate slot;

an adjustment mechanism associated with the body for attaching the body to the work table, the adjustment mechanism being configured for permitting the body to be adjusted on the work table along a first, x-axis parallel to the feed direction and a fastener receivable in the elongate slot in a direction parallel to a top of the work table and transverse to the feed direction, the fastener being configured for permitting the body to be adjusted along a second, y-axis perpendicular to the x-axis; and a roller assembly mounted on the body, the roller assembly including a roller mounted for rotation relative to the body, the roller being positioned at a skew angle relative to the body portion plane and to the feed direction when used to guide movement of the stock;

wherein the fastener comprises a first knob and a first screw configured to extend through the slot to attach the first knob to the body; and wherein the body includes a hole, and the adjustment mechanism further comprises a second knob and a second screw configured to extend through the hole to attach the second knob to the body.

2. A stock guide assembly as set forth in claim 1, wherein the skew angle is in the range of about 3 degrees to about 10 degrees.

3. A stock guide assembly as set forth in claim 1, wherein the roller assembly further comprises a roller mount associated with the body, the roller being attached to the roller mount.

4. A stock guide assembly as set forth in claim 3, wherein the roller mount comprises a mounting face extending at an angle to the body portion plane.

5. A stock guide assembly as set forth in claim 4, wherein the roller engages the mounting face to orient the roller at the skew angle relative to the body portion plane.

6. A stock guide assembly as set forth in claim 3, further comprising an axle, the roller being configured to rotate about the axle.

7. A stock guide assembly as set forth in claim 1, wherein the roller is configured for rotation in a first direction relative to the body and is prevented from rotating in a second direction opposite the first direction.

8. A stock guide assembly as set forth in claim 7, further comprising a one-way bearing configured to permit rotation of the roller in the first direction and prevent rotation of the roller in the second direction.

9. A stock guide assembly as set forth in claim 1, further comprising at least one O-ring disposed on the roller.

10. A stock guide assembly as set forth in claim 1, wherein the elongate slot is curved.

11. A stock guide assembly as set forth in claim 1, in combination with a router and a router table.

12. A stock guide assembly as set forth in claim 1, in combination with a second stock guide assembly comprising:

a body including a portion lying in a plane parallel to the feed direction when used to guide movement of the stock;

an adjustment mechanism associated with the body for attaching the body to the work table and permitting the body to be adjusted on the table along a first, x-axis and permitting the body to be adjusted along a second, y-axis; and a roller assembly mounted on the body, the roller assembly including a roller mounted for rotation relative to the body, the roller being positioned at a skew angle relative to the body portion plane and to the feed direction when used to guide movement of the stock.

13. A stock guide assembly for use with a work table to guide movement of stock along the work table in a feed direction, the stock guide assembly comprising:

a body including an elongate curved slot, a hole, and at least one opening, the body including a portion lying in a plane parallel to the feed direction when used to guide movement of the stock;

an adjustment mechanism associated with the body for attaching the body to the work table, the adjustment mechanism being associated with the elongate curved slot and the hole of the body to permit the body to be adjusted along a horizontal axis and to permit the body to be adjusted along a vertical axis; and a roller mount associated with the body and including a mounting face, the mounting face being angled relative to the body portion plane, the mounting face including a hole and a shoulder disposed in the hole;

an axle having a flange and a shaft that engages the shoulder, the axle being connected to the roller mount by a fastener that extends through the axle and through the hole in the mounting face; and a roller mounted on the axle and secured between the mounting face and the flange of the axle, the roller engaging the mounting face and being oriented at a skew angle relative to the body portion plane, the roller being configured for rotational movement about the shaft of the axle.

14. A stock guide assembly as set forth in claim 13, wherein the skew angle is in the range of about 3 degrees to about 10 degrees.

15. A stock guide assembly as set forth in claim 13, further comprising a one-way bearing configured to permit rotation of the roller in a first direction about the shaft of the axle and prevent rotation of the roller in a second direction opposite the first direction.

16. A stock guide assembly as set forth in claim 13, wherein the adjustment mechanism comprises a first knob and a first screw configured to extend through the curved slot to attach the first knob to the body.

17. A stock guide assembly as set forth in claim 16, wherein the adjustment mechanism further comprises a second knob and a second screw configured to extend through the hole to attach the second knob to the body.

18. A stock guide assembly as set forth in claim 12, in combination with a router and a router table.

* * * * *